US011851635B2

(12) United States Patent
Montes

(10) Patent No.: US 11,851,635 B2
(45) Date of Patent: Dec. 26, 2023

(54) NON-CAUSTIC SOLID POWDER CLEANER COMPRISING A CHELANT AND CARBONATE BASE COMBINATION

(71) Applicant: Magnus Procurement and Logistic Solutions, Inc., Frisco, TX (US)

(72) Inventor: Eric Matthew Montes, Allen, TX (US)

(73) Assignee: MAGNUS PROCUREMENT AND LOGISTIC SOLUTIONS, INC., Frisco, TX (US)

( * ) Notice: Subject to any disclaimer, the term of this patent is extended or adjusted under 35 U.S.C. 154(b) by 0 days.

(21) Appl. No.: 17/894,914

(22) Filed: Aug. 24, 2022

(65) Prior Publication Data

US 2023/0287312 A1 Sep. 14, 2023

Related U.S. Application Data

(60) Provisional application No. 63/318,251, filed on Mar. 9, 2022.

(51) Int. Cl.

| | |
|---|---|
| ***C11D 1/83*** | (2006.01) |
| ***C11D 11/00*** | (2006.01) |
| ***C11D 3/04*** | (2006.01) |
| ***C11D 3/08*** | (2006.01) |
| ***C11D 3/10*** | (2006.01) |
| ***C11D 3/20*** | (2006.01) |
| ***C11D 17/06*** | (2006.01) |
| ***C11D 3/22*** | (2006.01) |
| *C11D 1/72* | (2006.01) |
| *C11D 1/14* | (2006.01) |

(52) U.S. Cl.

CPC ..... *C11D 11/0029* (2013.01); *C11D 1/83* (2013.01); *C11D 3/046* (2013.01); *C11D 3/08* (2013.01); *C11D 3/10* (2013.01); *C11D 3/2068* (2013.01); *C11D 3/225* (2013.01); *C11D 17/06* (2013.01); *C11D 1/146* (2013.01); *C11D 1/72* (2013.01)

(58) Field of Classification Search

CPC .. C11D 1/146; C11D 1/72; C11D 3/33; C11D 3/43; C11D 7/12; C11D 7/5022; C11D 9/10; C11D 9/12; C11D 11/0023; C11D 17/06

See application file for complete search history.

(56) References Cited

U.S. PATENT DOCUMENTS

| | | | | |
|---|---|---|---|---|
| 6,673,765 | B1 * | 1/2004 | Schulz | C11D 3/128 510/447 |
| 6,734,155 | B1 * | 5/2004 | Herbots | C11D 3/3932 510/374 |
| 2010/0056416 | A1 * | 3/2010 | Scheuing | C11D 3/2044 510/284 |
| 2018/0072969 | A1 * | 3/2018 | Mccarthy | C11D 3/044 |
| 2022/0017844 | A1 * | 1/2022 | Benie | C11D 3/0047 |

* cited by examiner

*Primary Examiner* — Charles I Boyer
(74) *Attorney, Agent, or Firm* — William R. Childs; Childs Patent Law PLLC

(57) ABSTRACT

A non-caustic solid powder cleaner composition is disclosed herein, as well as a method of making and using the same. A benefit of the powder cleaner composition can be providing a compact, lightweight powder composition that can be easily and efficiently transported, stored, dispensed, and used for safely cleaning grill and oven surfaces.

12 Claims, No Drawings

NON-CAUSTIC SOLID POWDER CLEANER COMPRISING A CHELANT AND CARBONATE BASE COMBINATION

CROSS-REFERENCE TO RELATED APPLICATIONS

This U.S. Application claims priority to U.S. Provisional 63/318,251, filed on Mar. 9, 2022, the entirety of which is incorporated by reference.

TECHNICAL FIELD

Non-caustic solid powder cleaner compositions are disclosed herein, as well as methods of making and using the same. A benefit of the powder cleaner compositions can be providing a compact, lightweight powder composition that can be easily and efficiently transported, stored, dispensed, and added to water for safely cleaning grill and oven surfaces.

BACKGROUND

Grill and oven cleaning products are widely used as part of cleaning treatments to remove residues from the surfaces of various cooking appliances. It is well known that food residues frequently cling to the surfaces of grills and ovens. It is also well known that these cooking/food residues can harden during cooking, making them difficult to remove. Grill and oven cleaning liquids containing harsh chemicals are often used with strenuous scrubbing to remove such residues from the cooking surfaces of grills and ovens.

SUMMARY

A non-caustic solid powder cleaner composition is disclosed herein. In an embodiment, the non-caustic solid powder cleaner composition includes: at least one chelator comprising sodium metasilicate, Ethylenediaminetetraacetic acid (EDTA), ethylene glycol-bis(β-aminoethyl ether)-N,N,N',N'-tetraacetic acid (EGTA), sodium citrate, a carboxylic acid chelator, or a combination thereof; sodium chloride; at least one solid carbonate base comprising sodium carbonate, sodium bicarbonate, a carbonic acid salt, or a combination thereof; at least one thickening agent comprising hydroxyethylcellulose, agar, or a combination thereof; at least one stabilizer comprising ethylene glycol, ethylene glycol monobutyl ether, propylene glycol monoether, polyethylene glycol, or a combination thereof; and at least one surfactant. In an embodiment, the composition includes: from about 7.0% to about 19.0% by weight of sodium chloride; from about 48.25% to about 68.25% by weight of the at least one chelator; from about 10.2% to about 20.2% by weight of the at least one solid carbonate base; from about 0.2% to about 3.8% by weight of the at least one thickening agent; from about 0.2% to about 3.75% by weight of the at least one stabilizer; and from about 6.0% to about 16.0% by weight of the at least one surfactant, based on a total weight of the non-caustic solid powder cleaner composition. In various embodiments, the at least one surfactant includes: at least one ionic surfactant and at least one non-ionic surfactant, said at least one non-ionic surfactant comprising one or more alkoxylated alcohols. In various embodiments, the at least one surfactant includes: ethoxylated alcohol having a weight percent from about 2.0% by weight to about 12.0% by weight and sodium lauryl sulfate having a weight percent from about 2.0% to about 6.0% by weight in the solid powder cleaner composition, based on the total weight of the non-caustic solid powder cleaner composition. In an embodiment, the composition has a weight percent ratio of ethoxylated alcohol to sodium lauryl sulfate ranges from about 1:1.4 to about 1:2.2; a weight percent ratio of the ethoxylated alcohol to the at least one chelator ranges from about 1:13 to about 1:16; a weight percent ratio of the ethoxylated alcohol to the at least one solid carbonate base ranges from about 1:3.0 to about 1:4.5; or a weight percent ratio of the ethoxylated alcohol to sodium chloride ranges from about 1:2.5 to about 1:3.5, based on the total weight of the non-caustic solid powder cleaner composition. In an embodiment, the composition has a weight percent ratio of the combined weight percent of ethyoxylated alcohol and sodium lauryl sulfate to the at least one chelator ranges from about 1:5.0 to 1:5.5 based on the total weight of the non-caustic solid powder cleaner composition. In an embodiment, the composition has a weight percent ratio of the combined weight percent of ethyoxylated alcohol and sodium lauryl sulfate to the combined weight percent of sodium chloride, the at least one solid carbonate base, the at least one thickening agent and the at least one stabilizer ranges from about 1:2.5 to about 1:3.5 based on the total weight of the non-caustic solid powder cleaner composition.

The present disclosure also provides a non-caustic solid powder cleaner composition including: from about 7.0% to about 19.0% by weight of sodium chloride; from about 48.25% to about 68.25% by weight of sodium metasilicate; from about 10.2% to about 20.2% by weight of sodium carbonate; from about 0.2% to about 3.8% by weight of hydroxy ethyl cellulose; from about 0.2% to about 3.75% by weight of ethylene glycol monobutyl ether; from about 2.0% to about 12.0% by weight of sodium lauryl sulfate; and from about 2.0% to about 6.0% by weight of ethoxylated alcohol, based on a total weight of the non-caustic solid powder cleaner composition. In various embodiments, the composition has a weight percent ratio of the ethoxylated alcohol to sodium lauryl sulfate ranges from about 1:1.4 to about 1:2.2; a weight percent ratio of the ethoxylated alcohol to sodium metasilicate ranges from about 1:13 to about 1:16; a weight percent ratio of the ethoxylated alcohol to sodium carbonate ranges from about 1:3.0 to about 1:4.5; or a weight percent ratio of the ethoxylated alcohol to sodium chloride ranges from about 1:2.5 to about 1:3.5, based on the total weight of the non-caustic solid powder cleaner composition. In some embodiments, the composition has a weight percent ratio of the combined weight percent of ethyoxylated alcohol and sodium lauryl sulfate to sodium metasilicate ranges from about 1:5.0 to about 1:5.5 based on the total weight of the non-caustic solid powder cleaner composition. In some embodiments, the composition has a weight percent ratio of the combined weight percent of ethyoxylated alcohol and sodium lauryl sulfate to the combined weight percent of sodium chloride, sodium carbonate, hydroxy ethyl cellulose and ethylene glycol monobutyl ether ranges from about 1:2.5 to about 1:3.5, based on the total weight of the non-caustic solid powder cleaner composition. In an embodiment, the composition consists of from about 10.0% to about 14.0% by weight of sodium chloride; from about 53.25% to about 63.25% by weight of sodium metasilicate; from about 13.2% to about 17.2% by weight of sodium carbonate; from about 0.25% to about 3.0% by weight of hydroxy ethyl cellulose; from about 0.25% to about 3.0% by weight of ethylene glycol monobutyl ether; from about 5.0% to about 9.0% by weight of sodium lauryl sulfate; and from about 2.0% to about 6.0% by weight of ethoxylated alcohol, based on the total weight of the non-caustic solid powder cleaner composition.

The present disclosure also provides a method for manufacturing a non-caustic solid powder cleaner composition including: forming a solid mixture by combining sodium chloride, at least one chelator, at least one solid carbonate base, and at least one thickening agent; forming a surfactant mixture by combining an amount of an ethoxylated alcohol and an amount of sodium lauryl sulfate; adding at least one stabilizer to the solid mixture for a first time duration; and forming the non-caustic solid powder cleaner composition by adding the surfactant mixture to the solid mixture for a second time duration and mixing without grinding. In some embodiments, the method further includes monitoring homogeneity of the non-caustic solid powder cleaner composition by measuring density. In some embodiments, the first time duration is from about 3 minutes to about 8 minutes. In some embodiments, the second time duration is from about 3 minutes to about 8 minutes. In some embodiments, the first time duration and the second time duration are non-simultaneous. In various embodiments, at least one chelator includes sodium metasilicate, Ethylenediaminetetraacetic acid (EDTA), ethylene glycol-bis((3-aminoethyl ether)-N,N,N',N'-tetraacetic acid (EGTA), sodium citrate, a carboxylic acid chelator, or a combination thereof. In various embodiments, the at least one surfactant includes at least one ionic surfactant and at least one non-ionic surfactant, said at least one non-ionic surfactant comprising one or more alkoxylated alcohols and said at least one ionic surfactant comprising sodium lauryl sulfate. In various embodiments, the at least one solid carbonate base comprises sodium carbonate, sodium bicarbonate, a carbonic acid salt, or a combination thereof. In various embodiments, the at least one thickening agent comprises hydroxyethylcellulose, agar, or a combination thereof. In various embodiments, the at least one stabilizer comprises ethylene glycol, ethylene glycol monobutyl ether, propylene glycol monoether, polyethylene glycol, or a combination thereof. In various embodiments, the non-caustic solid powder cleaner composition includes: from about 7.0% to about 19.0% by weight of sodium chloride; from about 48.25% to about 68.25% by weight of sodium metasilicate; from about 10.2% to about 20.2% by weight of sodium carbonate; from about 0.2% to about 3.8% by weight of hydroxy ethyl cellulose; from about 0.2% to about 3.75% by weight of ethylene glycol monobutyl ether; from about 2.0% to about 12.0% by weight of sodium lauryl sulfate; and from about 2.0% to about 6.0% by weight of ethoxylated alcohol, based on the total weight of the non-caustic solid powder cleaner composition.

The present disclosure also provides a method of cleaning a surface including: providing a non-caustic solid powder cleaner composition that includes: from about 7.0% to about 19.0% by weight of sodium chloride; from about 48.25% to about 68.25% by weight of the at least one chelator; from about 10.2% to about 20.2% by weight of the at least one solid carbonate base; from about 0.2% to about 3.8% by weight of the at least one thickening agent; from about 0.2% to about 3.75% by weight of the at least one stabilizer; and from about 6.0% to about 16.0% by weight of the at least one surfactant, based on a total weight of the non-caustic solid powder cleaner composition; forming a non-caustic cleaning solution by adding an amount of the non-caustic solid powder cleaner composition to a volume of water, wherein the non-caustic cleaning solution has a weight concentration ranging from about 5 g/L to about 10 g/L; and applying the non-caustic cleaning solution to the surface, wherein the surface is a cooking surface of a grill or an interior surface of an oven.

The present disclosure also provides a kit for cleaning a surface, including: at least one vessel containing an amount of a non-caustic solid powder cleaner composition, wherein the composition comprises: from about 7.0% to about 19.0% by weight of sodium chloride; from about 48.25% to about 68.25% by weight of sodium metasilicate; from about 10.2% to about 20.2% by weight of sodium carbonate; from about 0.2% to about 3.8% by weight of hydroxy ethyl cellulose; from about 0.2% to about 3.75% by weight of ethylene glycol monobutyl ether; from about 2.0% to about 12.0% by weight of sodium lauryl sulfate; and from about 2.0% to about 6.0% by weight of ethoxylated alcohol, based on a total weight of the solid powder cleaner composition. In some embodiments, the at least one vessel includes a packet formed of a paper material, a plastic material, a plastic lined paper material, a wax paper, or a combination thereof. In some embodiments, the at least one vessel includes a single-use packet formed of a paper material, a plastic material, a plastic lined paper material, a wax paper, or a combination thereof. In some embodiments, the amount of a non-caustic solid powder cleaner composition ranges from about 50 g to about 150 g.

DETAILED DESCRIPTION

Unless otherwise noted, all measurements are in standard metric units.

Unless otherwise noted, all instances of the words "a," "an," or "the" can refer to one or more than one of the word that they modify.

Unless otherwise noted, the phrase "at least one of" means one or more than one of an object and can be combined with one or more of another object in the same list in any combination.

Unless otherwise noted, the term "about" refers to ±10% of the non-percentage number that is described, rounded to the nearest whole tenth of an integer. For example, "about 8 minutes" would include 7.2 minutes to 8.8 minutes. Unless otherwise noted, the term "about" refers to ±5% of a percentage number. For example, "about 19% by weight" would include 14% to 24% by weight. When the term "about" is discussed in terms of a range, then the term refers to the appropriate amount less than the lower limit and more than the upper limit. For example, from "from about 7.0% to about 19.0% by weight" would include from 2.0% to 24.0% by weight.

Unless otherwise noted, properties (weight, ratio, etc.) as described herein are understood to be averaged measurements.

Unless otherwise noted, the terms "provide", "provided" or "providing" refer to the supply, production, purchase, manufacture, assembly, formation, selection, configuration, conversion, introduction, addition, or incorporation of any element, amount, component, reagent, quantity, measurement, or analysis of any method or system of any embodiment herein.

Unless otherwise noted, the phrase "consisting essentially of" should be interpreted as a semi-closed term, meaning that no other ingredient is included that would change the chemical or physical properties of the composition, other than to add volume and weight. An example of an ingredient that would not change the chemical and physical properties of the composition would be a filler or excipient.

Unless otherwise noted, the terms "cleaner," "cleaning composition," and "cleaner composition" can be used interchangeably.

Unless otherwise noted, the terms "solid powder cleaner" and "solid powder cleaner composition" can be used interchangeably.

Unless otherwise noted, the term "non-caustic" refers to a composition that excludes from 100 to 1 weight percent of sodium hydroxide and/or potassium hydroxide; or a composition that includes from about 0% to about 1% weight, including 0% weight, of sodium hydroxide and/or potassium hydroxide, based on a total weight of the composition.

Unless otherwise noted, the term "powder" refers to a solid, wherein a random sample of the solid contains particles, and about 80% to about 100% of the measured particles have a particle size of from about 0.5 micrometers to about 100 micrometers, as measured across the longest dimension of the particle.

Grills and ovens are indispensable in most restaurants, bars, bakeries, hotels, and even homes. Grills and ovens must be cleaned frequently to remove cooking residues from surfaces of the grill or oven. These residues cannot be ignored because the residues can adversely change the taste of the food being prepared, and the residues, if left in place during subsequent operations, tend to produce smoke. Smoke coming from the kitchen tends to trigger fire alarms and disturb consumers. Further, many commercial kitchens are required by health regulations to clean grills and ovens regularly. Proper and frequent cleaning of grills and ovens is therefore necessary.

Once a grill or oven contains cooking residues that need removal, the grill or oven typically must be cleaned with the use of a cleaner. Many liquid cleaners contain strong caustic bases, such as sodium hydroxide, to help dislodge, break up, and dissolve the cooking residue. The base selected must not only be effective in dissolving the cooking residue but must also be of food grade in quality and safe to use without damaging the surfaces of grill or oven. It is also greatly preferred if the base selected does not reek of ammonia or ammonium, which typically smells like rotting fish. A rotting fish smell is generally undesirable, especially if emanating from a restaurant kitchen. To avoid this ammonia smell and to provide a high pH of 11 to 13, several bases are commonly used in the formulations of grill and oven cleaners, such as hydroxide salts, including sodium hydroxide and/or potassium hydroxide. However, these hydroxide salts tend to be caustic upon coming in contact with metals and can pose a health hazard to the workers such as damaging the eyes upon coming in contact and damaging the skin upon prolonged contact while cleaning.

Many conventional grill and oven cleaning agents are sold as liquids, including high viscosity liquids. Liquid products are bulky, take up a large amount of transport space for shipment and storage. Liquid products are generally heavy, which increases energy costs during transportation. Liquids are also typically more difficult to process through international shipping channels due to customs regulations. Government regulations may also impose certain requirements for the disposal of containers of liquid materials regarded as hazardous. Therefore, many liquid containers cannot be reused, which results in the containers, usually plastic, being thrown into landfills. Moreover, liquids are usually more difficult for workers to measure in practice because the high viscosity of the liquid cleaners tends to clog liquid dispensers and measuring devices. Even low viscosity liquid cleaners tend to have volatile components which evaporate over time during storage or use, turning a low viscosity liquid cleaner into a higher viscosity liquid cleaner that clogs the liquid dispenser as the liquid dispenser was only designed to disperse a low viscosity liquid.

In contrast, products sold as powders can have advantages of greatly decreased weight and lower space requirements. These lower weight and space requirements aid in reducing shipping costs, storage costs, and minimize environmental impact of the cleaning agents as less gas or electricity is needed to ship them. Further, powders generally present fewer difficulties for transportation due to relaxed customs and safety regulations. The packages for powdered formulations are also generally more convenient and easier to dispose-of safely than liquid containers. For example, powders can be shipped and stored in paper containers that are biodegradable and environmentally sustainable. Cleaner powders can be combined with water to form the actual cleaning solution at the site of cleaning, which avoids forcing workers to carry around heavy containers. It also avoids clogging cleaning dispensers because high viscosity and evaporation are no longer the problems. Powders can also allow the user to mix a more concentrated cleaning solution by increasing the powder to water ratio. Powder cleaner compositions can also avoid the labor and equipment necessary to measure out an appropriate amount of the cleaner composition because the packaging itself can be used as a disposable dose measurement.

Packaged powdered products can present their own challenges as well. The powdered product needs to flow more or less completely and efficiently out of the packaging when dispensed, without powder particles dispersing into the air, or remaining stuck within the packaging. Accordingly, there remains a need for a non-caustic solid powder cleaner composition that can provide the benefits of being compact, lightweight, environment friendly, cost-effective packaging, as well as safe, efficient, and easily dispensable for use.

It has been discovered that it is possible to create a cleaner composition that uses commercially available components but combines these components in percentages and ratios that allows for the composition to maintain a solid powder form. Further, it has been discovered that the cleaner composition can be non-caustic in its powder form and can be combined with water to form a non-caustic cleaning solution. Furthermore, it has been discovered that the inclusion of sodium chloride aids in building the structure to keep the formulation in a solid powder form and inclusion of a thickening agent in the composition aids in eliminating (or at least in reducing) stickiness in the powder and improve flowability of the powder. It has also been discovered that inclusion of surfactant(s) in the composition aid in producing foam, which aids in dissolving and/or dispersing oils, grease and dirt, and inclusion of a chelator aid in sequestering metal ions, while inclusion of mild base(s) (such as solid carbonate bases) improve the cleaning efficiency. Notably, inclusion of a combination of at least one ionic surfactant (such as sodium lauryl sulfate) and at least one nonionic surfactant (such as alkoxylated alcohols) in the composition improves the cleaning efficiency of the composition. Embodiments herein can provide a low cost, lightweight, compact non-caustic solid powder cleaner that can be safely, easily, and effectively dispensed for use.

In various embodiments, the non-caustic solid powder cleaner composition includes at least one chelator. Exemplary chelators that may be used in the composition of the present disclosure includes, but not limited to, sodium metasilicate, ethylenediaminetetraacetic acid (EDTA), ethylene glycol-bis(β-aminoethyl ether)-N,N,N',N'-tetraacetic acid (EGTA), sodium citrate, potassium citrate, a carboxylic acid chelator and combinations thereof. Inclusion of chelator aids in sequestering metals in the solution, especially the calcium ions of hard water, which tend to reduce the ability of the cleaner composition to produce foam. An additional benefit of chelators, such as EDTA, EGTA, and sodium citrate, is that they are solid at room temperature, which helps in keeping the cleaner composition in the form of a solid powder. Suitable carboxylic acid chelators can include carbonic acid, aspartic acid, 2-ketogluconic acid, and/or aminopolycarboxylic acid (APCA). In various embodiments, the non-caustic solid powder cleaner composition includes from about 48.25% to about 68.25% by weight of the at least one chelator, including from about 53.25% to about 63.25% by weight of the at least one chelator, and including from about 56.25% to about 60.25% by weight of the at least one chelator, based on the total weight of the non-caustic solid powder cleaner composition.

In various embodiments, the non-caustic solid powder cleaner composition includes from about 48.25% to about 68.25% by weight of sodium metasilicate, including from about 53.25% to about 63.25% by weight of sodium metasilicate, and including from about 56.25% to about 60.25% by weight of sodium metasilicate, based on a total weight of the non-caustic solid powder cleaner. Usage of anhydrous sodium metasilicate is particularly suitable for realizing the advantageous composition of the present disclosure. If the amount of chelator is increased above about 68.25% by weight or decreased below about 48.25% by weight, then the cleaning efficiency of the cleaner composition may be reduced.

In various embodiments, the non-caustic solid powder cleaner composition includes sodium chloride. Inclusion of sodium chloride aids in building a structure to keep the formulation in a solid powder form. It has been found that it is possible to maintain the non-caustic cleaner composition as a solid powder when sodium chloride is included in particular amounts and ratios in the composition, as will be described herein. In various embodiments, the non-caustic solid powder cleaner composition includes from about 7.0% to about 19.0% by weight of sodium chloride, including from about 10.0% to about 14.0% by weight of sodium chloride, and including from about 11.0% to about 13.0% by weight of the sodium chloride, based on a total weight of the non-caustic solid powder cleaner composition. If the amount of sodium chloride in the cleaner composition goes below about 7% by weight, then the solid powder form (consistency) of the cleaner composition may be compromised. If the amount of sodium chloride in the cleaner composition goes dramatically above about 19%, then the cleaner composition may lose cleaning efficiency because sodium chloride offers little to help dissolve dirt or grease.

In various embodiments, the non-caustic solid powder cleaner composition includes a mild base such as at least one solid carbonate base. Inclusion of mild base(s) such as solid carbonate base(s) help raise pH of the solution created when the powder is dissolved in water to an acceptable pH, typically a pH of 11 to a pH 13, which improves the cleaning efficiency. A benefit of solid carbonate bases can be that they are solid and aid in keeping the cleaner composition in solid powder form. Exemplary solid carbonate bases that may be used in the composition of the present disclosure includes, but not limited to, sodium carbonate, sodium bicarbonate, potassium carbonate, calcium carbonate, magnesium carbonate, a carbonic acid salt and combinations thereof. In various embodiments, the non-caustic solid powder cleaner composition includes a solid carbonate base that includes sodium carbonate, sodium bicarbonate, potassium carbonate, calcium carbonate, magnesium carbonate, a carbonic acid salt or combinations thereof. In the context of the solid carbonate base, the term "about" means±5.0% by weight based on a total weight of the non-caustic solid powder cleaner composition. In various embodiments, the non-caustic solid powder cleaner composition includes from about 10.2% to about 20.2% by weight of the at least one solid carbonate base, including from 13.2% to about 17.2% by weight of the at least one solid carbonate base, based on a total weight of the non-caustic solid powder cleaner composition. In various embodiments, the non-caustic solid powder cleaner composition includes from about 10.2% to about 20.2% by weight of sodium carbonate, including from about 13.2% to about 17.2% by weight of sodium carbonate, based on a total weight of the non-caustic solid powder cleaner. If the amount of solid carbonate base is increased above about 20.2% by weight, then the cleaning solution formed upon dissolving the solid powder cleaner composition in water may be too caustic/basic for safe commercial use. If the amount of solid carbonate base is decreased below about 10.2% by weight, then the cleaning solution formed upon dissolving the solid powder cleaner composition in water may have reduced cleaning efficiency because, in general, the higher the pH, the better is the cleaning efficiency.

In various embodiments, the non-caustic solid powder cleaner composition includes at least one thickening agent. Inclusion of thickening agent aids in eliminating or reducing the stickiness of the composition and aids to keep the composition in the form of a solid powder, improving flowability thereof. Exemplary thickening agents that may be used in the composition of the present disclosure includes, but not limited to, hydroxyethylcellulose, agar and combinations thereof. In the context of the thickening agent, the term "about" means±0.1% by weight based on a total weight of the non-caustic solid powder cleaner. In various embodiments, the non-caustic solid powder cleaner composition includes from about 0.2% to about 3.8% by weight of the at least one thickening agent, including from about 0.5% to about 2.8% by weight of the at least one thickening agent and including from about 1.3% to about 2.3% by weight of the at least one thickening agent. In various embodiments, the non-caustic solid powder cleaner composition includes from about 0.2% to about 3.8% by weight of hydroxyethylcellulose, including from about 0.5% to about 2.8% by weight of hydroxyethylcellulose and including from about 1.3% to about 2.3% by weight of hydroxyethylcellulose. If the amount of thickening agent is increased dramatically above about 3.8% by weight, the cleaning efficiency of the composition may be reduced. If the amount of thickening agent is decreased below about 0.2% by weight, the ability of the composition to be maintained as a solid powder, especially in a high humidity environment, is reduced or lost.

In various embodiments, the non-caustic solid powder cleaner composition includes at least one stabilizer. Inclusion of stabilizer(s) in the composition may aid in dissolution of the thickening agent(s) in water. Exemplary stabilizers that may be used in the composition of the present disclosure includes, but not limited to, ethylene glycol, ethylene glycol monobutyl ether, propylene glycol monoether, polyethylene glycol and combinations thereof. In the context of the stabilizer, the term "about" means±0.1% by weight based on a total weight of the non-caustic solid powder cleaner. In various embodiments, the non-caustic solid powder cleaner composition includes from about 0.2% to about 3.75% by weight of the at least one stabilizer, including from about 0.5% to about 2.75% by weight of the at least one stabilizer, including from about 1.25% to about 2.25% by weight of the at least one stabilizer, based on a total weight of the non-caustic solid powder cleaner. In various embodiments, the non-caustic solid powder cleaner composition includes from about 0.2% to about 3.75% by weight of ethylene glycol monobutyl ether, including from about 0.5% to about 2.75% by weight of ethylene glycol monobutyl ether, including from about 1.25% to about 2.25% by weight of ethylene glycol monobutyl ether, based on a total weight of the non-caustic solid powder cleaner. If the amount of stabilizer is increased above about 3.75%, then the cleaning efficiency of the cleaner composition may be reduced. If the amount of stabilizer is decreased below about 0.2%, then thickener is not adequately dissolved in water.

In various embodiments, the non-caustic solid powder cleaner composition includes at least one surfactant. Inclusion of surfactant(s) in the cleaner composition aid in formation of foam, which aids in dissolving and/or dispersing oils, grease and dirt. Inclusion of a combination of at least one ionic surfactant and at least one non-ionic surfactant in the composition aids in improving the cleaning efficiency of the composition. In various embodiments, the composition includes a combination of at least one anionic surfactant and at least one non-ionic surfactant. Exemplary non-ionic surfactants that may be used in the composition of the present disclosure includes, but not limited to, ethoxylated alcohol, propoxylated alcohol and combinations thereof. Exemplary ionic surfactants that may be used in the composition of the present disclosure includes, but not limited to, sodium lauryl sulfate, sodium lauroyl sarcosinate, sodium myreth sulfate, sodium laureth sulfate, sodium stearate, ammonium lauryl sulfate, α-olefin sulfonate, ammonium laureth sulfate and combinations thereof. In the context of the surfactants, the term "about" means±1.0% by weight based on a total weight of the non-caustic solid powder cleaner. In various embodiments, the non-caustic solid powder cleaner composition includes from about 6.0% to about 16.0% by weight of the at least one surfactant, including from about 9.0% to about 13.0% by weight of the at least one surfactant, based on a total weight of the non-caustic solid powder cleaner composition. In various embodiments, the non-caustic solid powder cleaner composition includes from about 2.0% to about 12.0% by weight of the ionic surfactant, including from about 5.0% to about 9.0% by weight of the ionic surfactant, based on a total weight of the non-caustic solid powder cleaner composition. In various embodiments, the non-caustic solid powder cleaner composition includes from about 2.0% to about 6.0% by weight of the non-ionic surfactant, including from about 3.0% to about 5.0% by weight of the non-ionic surfactant, based on a total weight of the non-caustic solid powder cleaner composition. In various embodiments, the non-caustic solid powder cleaner composition includes from about 2.0% to about 12.0% by weight of the ionic surfactant and from about 2.0% to about 6.0% by weight of the non-ionic surfactant, based on a total weight of the non-caustic solid powder cleaner composition. In various embodiments, the non-caustic solid powder cleaner composition includes from about 5.0% to about 9.0% by weight of the ionic surfactant and from about 3.0% to about 5.0% by weight of the non-ionic surfactant, based on a total weight of the non-caustic solid powder cleaner composition. In various embodiments, the non-caustic solid powder cleaner composition includes from about 2.0% to about 12.0% by weight of sodium lauryl sulfate and from about 2.0% to about 6.0% by weight of ethoxylated alcohol, based on a total weight of the non-caustic solid powder cleaner composition. In various embodiments, the non-caustic solid powder cleaner composition includes from about 5.0% to about 9.0% by weight of sodium lauryl sulfate and from about 3.0% to about 5.0% by weight of ethoxylated alcohol, based on a total weight of the non-caustic solid powder cleaner composition.

In addition to the ranges of weight percentage discussed above for various embodiments of the non-caustic solid powder cleaner composition, it has been discovered that the ratio of certain components relative to other components can be important for maintaining the cleaner composition in the form of a solid powder and/or for obtaining desired cleaning efficiency of the cleaner composition.

In various embodiments, the composition has a weight percent ratio of ethoxylated alcohol to sodium lauryl sulfate ranging from about 1:1.4 to about 1:2.2, including a weight percent ratio of ethoxylated alcohol to sodium lauryl sulfate ranging from about 1:1.5 to about 1:2.0, including a weight percent ratio of ethoxylated alcohol to sodium lauryl sulfate ranging from about 1:1.65 to about 1:1.85, based on the total weight of the non-caustic solid powder cleaner.

In various embodiments, the composition has a weight percent ratio of the ethoxylated alcohol to the at least one chelator ranging from about 1:13 to about 1:16, including a weight percent ratio of the ethoxylated alcohol to the at least one chelator ranging from about 1:13 to about 1:15, based on the total weight of the non-caustic solid powder cleaner.

In various embodiments, the composition has a weight percent ratio of the ethoxylated alcohol to the at least one solid carbonate base ranging from about 1:3.0 to about 1:4.5, including a weight percent ratio of the ethoxylated alcohol to the at least one solid carbonate base ranging from about 1:3.5 to about 1:4.1, including a weight percent ratio of the ethoxylated alcohol to the at least one solid carbonate base ranging from about 1:3.7 to about 1:3.9, based on the total weight of the non-caustic solid powder cleaner.

In various embodiments, the composition has a weight percent ratio of the ethoxylated alcohol to sodium chloride ranging from about 1:2.5 to about 1:3.5, including a weight percent ratio of the ethoxylated alcohol to sodium chloride ranging from about 1:2.7 to about 1:3.2, including a weight percent ratio of the ethoxylated alcohol to sodium chloride ranging from about 1:2.9 to about 1:3.1, based on the total weight of the non-caustic solid powder cleaner.

In various embodiments, the composition has a weight percent ratio of the combined weight percent of ethyoxylated alcohol and sodium lauryl sulfate to the at least one chelator ranging from about 1:5.0 to 1:5.5, including a weight percent ratio of the combined weight percent of ethyoxylated alcohol and sodium lauryl sulfate to the at least one chelator ranging from about 1:5.2 to 1:5.4, based on the total weight of the non-caustic solid powder cleaner.

In various embodiments, the composition has a weight percent ratio of the combined weight percent of ethyoxylated alcohol and sodium lauryl sulfate to the combined weight percent of sodium chloride, the at least one solid carbonate base, the at least one thickening agent and the at least one stabilizer ranging from about 1:2.5 to about 1:3.5, including a weight percent ratio of the combined weight percent of ethyoxylated alcohol and sodium lauryl sulfate to the combined weight percent of sodium chloride, the at least one solid carbonate base, the at least one thickening agent and the at least one stabilizer ranging from about 1:2.7 to about 1:2.9, based on the total weight of the non-caustic solid powder cleaner composition.

To compute a weight percent ratio as used herein, the weight percent of each component, as disclosed herein, is used to form a ratio. For example, a ratio of ethoxylated alcohol to sodium lauryl sulfate of 1:1.4 would be a ratio 1% by weight ethoxylated alcohol by a total weight of the of the non-caustic solid powder cleaner to a 1.4% by weight of sodium lauryl sulfate based on the total weight of the of the non-caustic solid powder cleaner. The weight percent ratio can also be computed as 1% weight divided by 1.4% weight to yield a unitless number of 0.71.

The present disclosure also provides a non-caustic solid powder cleaner composition including: from about 7.0% to about 19.0% by weight of sodium chloride; from about 48.25% to about 68.25% by weight of sodium metasilicate; from about 10.2% to about 20.2% by weight of sodium carbonate; from about 0.2% to about 3.8% by weight of hydroxy ethyl cellulose; from about 0.2% to about 3.75% by weight of ethylene glycol monobutyl ether; from about 2.0% to about 12.0% by weight of sodium lauryl sulfate; and from about 2.0% to about 6.0% by weight of ethoxylated alcohol, based on a total weight of the non-caustic solid powder cleaner composition. In various embodiments, the composition has a weight percent ratio of the ethoxylated alcohol to sodium lauryl sulfate ranges from about 1:1.4 to about 1:2.2; a weight percent ratio of the ethoxylated alcohol to sodium metasilicate ranges from about 1:13 to about 1:16; a weight percent ratio of the ethoxylated alcohol to sodium carbonate ranges from about 1:3.0 to about 1:4.5; or a weight percent ratio of the ethoxylated alcohol to sodium chloride ranges from about 1:2.5 to about 1:3.5, based on the total weight of the non-caustic solid powder cleaner composition. In some embodiments, the composition has a weight percent ratio of the combined weight percent of ethyoxylated alcohol and sodium lauryl sulfate to sodium metasilicate ranges from about 1:5.0 to 1:5.5 based on the total weight of the non-caustic solid powder cleaner composition. In some embodiments, the composition has a weight percent ratio of the combined weight percent of ethyoxylated alcohol and sodium lauryl sulfate to the combined weight percent of sodium chloride, sodium carbonate, hydroxy ethyl cellulose and ethylene glycol monobutyl ether ranges from about 1:2.5 to about 1:3.5, based on the total weight of the non-caustic solid powder cleaner composition. In an embodiment, the composition consists of from about 10.0% to about 14.0% by weight of sodium chloride; from about 53.25% to about 63.25% by weight of sodium metasilicate; from about 13.2% to about 17.2% by weight of sodium carbonate; from about 0.25% to about 3.0% by weight of hydroxy ethyl cellulose; from about 0.25% to about 3.0% by weight of ethylene glycol monobutyl ether; from about 5.0% to about 9.0% by weight of sodium lauryl sulfate; and from about 2.0% to about 6.0% by weight of ethoxylated alcohol, based on a total weight of the non-caustic solid powder cleaner composition.

A method for manufacturing a non-caustic solid powder cleaner composition has been discovered. It has been discovered that it is possible to manufacturer a solid powder cleaner composition by controlling reaction conditions, including the order of addition of ingredients, duration of addition of the ingredients and/or the pressure applied during mixing of the ingredients. In various embodiments, the method for manufacturing a non-caustic solid powder cleaner composition includes: forming a solid mixture by combining sodium chloride, at least one chelator, at least one solid carbonate base, and at least one thickening agent; forming a surfactant mixture by combining an amount of an ethoxylated alcohol and an amount of sodium lauryl sulfate; adding at least one stabilizer to the solid mixture for a first time duration; and forming the non-caustic solid powder cleaner composition by adding the surfactant mixture to the solid mixture for a second time duration and mixing without grinding. In various embodiments, sodium chloride, at least one chelator, at least one solid carbonate base, and at least one thickening agent are mixed without grinding to form the solid mixture. In various embodiments, the surfactant mixture is formed by combining or mixing an amount of an ethoxylated alcohol and an amount of sodium lauryl sulfate without grinding. It has been discovered that the surfactants should be premixed into a surfactant mixture before combining/mixing with the solid mixture to preclude clumping of the ingredients and resultant loss of the texture/structure of the solid powder. In various embodiments, the surfactant mixture and the solid mixture can be formed simultaneously or in any order so long as they are formed separately. In various embodiments of the method, it has been discovered that the steps of adding the at least one stabilizer to the solid mixture and adding the surfactant mixture to the solid mixture should be performed after forming the solid mixture, else the cleaner composition may lose its form/structure as a solid powder. In various embodiments of the method, the method includes mixing without grinding or milling. In various embodiments of the method, the method excludes grinding or milling. In various embodiments of the method, it has been discovered that grinding the components of the non-caustic solid powder cleaner composition causes the components to form a solid mass or clumps of material that do not flow like a solid powder. In some embodiments, the method further includes monitoring homogeneity of the non-caustic solid powder cleaner composition by measuring density. In various embodiments, the first time duration is from about 3 minutes to about 8 minutes. In various embodiments, the second time duration is from about 3 minutes to about 8 minutes. In various embodiments, the first time duration and the second time duration are non-simultaneous. In various embodiments, at least one chelator includes sodium metasilicate, Ethylenediaminetetraacetic acid (EDTA), ethylene glycol-bis(3-aminoethyl ether)-N,N,N',N'-tetraacetic acid (EGTA), sodium citrate, a carboxylic acid chelator, or a combination thereof. In various embodiments, the at least one surfactant includes at least one ionic surfactant and at least one non-ionic surfactant, said at least one non-ionic surfactant comprising one or more alkoxylated alcohols and said at least one ionic surfactant comprising sodium lauryl sulfate. In various embodiments, the at least one solid carbonate base comprises sodium carbonate, sodium bicarbonate, a carbonic acid salt, or a combination thereof, and wherein the at least one thickening agent comprises hydroxyethylcellulose, agar, or a combination thereof. In various embodiments, the at least one stabilizer comprises ethylene glycol, ethylene glycol monobutyl ether, propylene glycol monoether, polyethylene glycol, or a combination thereof. In various embodiments, the non-caustic solid powder cleaner composition includes: from about 7.0% to about 19.0% by weight of sodium chloride; from about 48.25% to about 68.25% by weight of sodium metasilicate; from about 10.2% to about 20.2% by weight of sodium carbonate; from about 0.2% to about 3.8% by weight of hydroxy ethyl cellulose; from about 0.2% to about 3.75% by weight of ethylene glycol monobutyl ether; from about 2.0% to about 12.0% by weight of sodium lauryl sulfate; and from about 2.0% to about 6.0% by weight of ethoxylated alcohol, based on a total weight of the non-caustic solid powder cleaner composition.

A method of cleaning a surface is disclosed herein. In various embodiments, the method includes providing a non-caustic solid powder cleaner composition including: from about 7.0% to about 19.0% by weight of sodium chloride; from about 48.25% to about 68.25% by weight of the at least one chelator; from about 10.2% to about 20.2% by weight of the at least one solid carbonate base; from about 0.2% to about 3.8% by weight of the at least one thickening agent; from about 0.2% to about 3.75% by weight of the at least one stabilizer; and from about 6.0% to about 16.0% by weight of the at least one surfactant, based on a total weight of the non-caustic solid powder cleaner composition or any embodiment of the non-caustic solid powder cleaner composition as disclosed herein; and forming a non-caustic cleaning solution by adding an amount of the non-caustic solid powder cleaner composition to a volume of water; and applying the non-caustic cleaning solution to the surface, wherein the surface is a cooking surface of a grill or an interior surface of an oven. In various embodiments, the non-caustic cleaning solution has a weight/volume concentration ranging from about 5 g/L to about 10 g/L.

In various embodiments, the method includes applying the non-caustic cleaning solution directly to the cooking surface of a grill or an interior surface of an oven. In various embodiments, the method includes applying the non-caustic cleaning solution indirectly to the cooking surface of a grill or an interior surface of an oven by applying the non-caustic cleaning solution to a sponge or brush, and then contacting the sponge or brush to the surface of a grill or the interior surface of an oven.

A kit is disclosed herein. In various embodiments, the kit includes at least one vessel containing an amount of a non-caustic solid powder cleaner composition, wherein the composition includes: from about 7.0% to about 19.0% by weight of sodium chloride; from about 48.25% to about 68.25% by weight of the at least one chelator; from about 10.2% to about 20.2% by weight of the at least one solid carbonate base; from about 0.2% to about 3.8% by weight of the at least one thickening agent; from about 0.2% to about 3.75% by weight of the at least one stabilizer; and from about 6.0% to about 16.0% by weight of the at least one surfactant, based on a total weight of the non-caustic solid powder cleaner composition or any other embodiment of the non-caustic solid powder cleaner composition disclosed herein. A benefit of the kit can be providing the non-caustic solid powder cleaner composition in a packet formed of a paper material, a plastic material, a plastic lined paper material, a wax paper, or a combination thereof. A benefit of using such packing materials can include reducing environmental impact by using biodegradable materials such as a biodegradable paper material, using recycled paper material, or avoiding using plastic materials, as used by conventional liquid containers. In some embodiments, the at least one vessel includes a single-use packet formed of a paper material, a plastic material, a plastic lined paper material, a wax paper, or a combination thereof. In various embodiments, the kit includes the amount of a non-caustic solid powder cleaner composition ranging from about 50 g to about 150 g. A benefit of a kit containing such an amount non-caustic solid powder cleaner composition can be that the packaging itself afford a measurement for consumers. The use of the kit or package containing the non-caustic solid powder cleaner composition as a measuring tool precludes the need to clean or maintain measuring tools and allows for each use to be measured accurately by simply opening the package and pouring out the contents into water to form the non-caustic cleaning solution.

Examples

Ingredients

TABLE 1

| Ingredient | CAS Number | Purity | Appearance | Weight % of composition |
|---|---|---|---|---|
| Sodium Chloride (NaCl) | 7647-14-5 | >99% | White powder | 12.00 |
| Sodium Metasilicate Anhydrous ($Na_2SiO_3$) | 6834-92-0 | 50-60% | Off white crystalline powder | 58.25 |
| Sodium Carbonate | 497-19-8 | 99.5 | White powder | 15.2 |
| Hydroxy Ethyl Cellulose QP-52000-H (CELLOSIZE ®) | 9004-62-0 | Industrial grade (86-100%) | White to off-white Powder | 1.8 |
| Ethylene Glycol Monobutyl ether | 111-76-2 | 99.0 | Clear liquid | 1.75 |
| sodium lauryl sulfate ($NaC_{12}H_{25}SO_4$) | 151-21-3 | — | Solid | 7 |
| Ethoxylated Alcohol | NA | NA | NA | 4 |

Formulation

1. Thoroughly mix all the solid ingredients from the Table above: Namely, sodium chloride, $Na_2SiO_3$, $Na_2CO_3$, and CELLOSIZE® to form a "SOLID MIXTURE," without grinding.
2. Separately from the SOLID MIXTURE, mix ethoxylated alcohol and sodium lauryl sulfate to form a "SURFACTANT MIXTURE."
3. Sequentially, add to the SOLID MIXTURE:
   a. Ethylene Glycol Monobutyl ether over the course of 3-8 minutes of mixing without grinding
   b. The SURFACTANT MIXTURE over the course of 3-8 minutes of mixing without grinding
   c. To obtain a dry solid powder detergent.
4. Check homogeneity of the dry solid powder detergent by measuring apparent density against the expected density.

Use of Formulation

5. Prepare a liquid cleaning solution by diluting 100 g of the dry solid powder detergent in 3.26 L of water.

What is claimed is:

1. A non-caustic solid powder cleaner composition comprising:

A) at least one chelator selected from the group consisting of sodium metasilicate, Ethylenediaminetetraacetic acid (EDTA), ethylene glycol-bis(B-aminoethyl ether)-

N,N,N',N'-tetraacetic acid (EGTA), sodium citrate, a carboxylic acid chelator, or a combination thereof;

B) sodium chloride;

C) at least one solid carbonate base selected from the group consisting of sodium carbonate, sodium bicarbonate, a carbonic acid salt, or a combination thereof;

D) at least one thickening agent selected from the group consisting of hydroxyethylcellulose, agar, or a combination thereof;

E) at least one stabilizer selected from the group consisting of ethylene glycol, ethylene glycol monobutyl ether, polyethylene glycol, or a combination thereof;

F) a surfactant system comprising:

i) sodium lauryl sulfate having a weight percent from about 2.0% by weight to about 12.0% by weight, based on a total weight of the non-caustic solid powder cleaner composition; and ii) ethoxylated alcohol having a weight percent from about 2.0% to about 6.0% by weight, based on a total weight of the non-caustic solid powder cleaner composition, and wherein:

a) a weight percent ratio of ethoxylated alcohol to sodium lauryl sulfate ranges from about 1:1.4 to about 1:2.2;

b) a weight percent ratio of the ethoxylated alcohol to the at least one chelator ranges from about 1:13 to about 1:16;

c) a weight percent ratio of the ethoxylated alcohol to the at least one solid carbonate base ranges from about 1:3.0 to about 1:4.5; or d) a weight percent ratio of the ethoxylated alcohol to sodium chloride ranges from about 1:2.5 to about 1:3.5, based on the total weight of the non-caustic solid powder cleaner composition.

2. A non-caustic solid powder cleaner composition comprising:

A) from about 48.25% to about 68.25% by weight of at least one chelator selected from the group consisting of sodium metasilicate, Ethylenediaminetetraacetic acid (EDTA), ethylene glycol-bis(B-aminoethyl ether)-N,N,N',N'-tetraacetic acid (EGTA), sodium citrate, a carboxylic acid chelator, or a combination thereof;

B) from about 7.0% to about 19.0% by weight of sodium chloride;

C) from about 10.2% to about 20.2% by weight of at least one solid carbonate base selected from the group consisting of sodium carbonate, sodium bicarbonate, a carbonic acid salt, or a combination thereof;

D) from about 0.2% to about 3.8% by weight of at least one thickening agent selected from the group consisting of hydroxyethylcellulose, agar, or a combination thereof;

E) from about 0.2% to about 3.75% by weight of at least one stabilizer selected from the group consisting of ethylene glycol, ethylene glycol monobutyl ether, polyethylene glycol, or a combination thereof; and F) from about 6.0% to about 16.0% by weight of at least one surfactant, based on a total weight of the non-caustic solid powder cleaner composition.

3. The composition of claim 1, wherein:

a weight percent ratio of the combined weight percent of ethyoxylated alcohol and sodium lauryl sulfate to the at least one chelator ranges from about 1:5.0 to 1:5.5; or a weight percent ratio of the combined weight percent of ethyoxylated alcohol and sodium lauryl sulfate to the combined weight percent of sodium chloride, the at least one solid carbonate base, the at least one thickening agent and the at least one stabilizer ranges from about 1:2.5 to about 1:3.5, based on the total weight of the non-caustic solid powder cleaner composition.

4. A non-caustic solid powder cleaner composition comprising:

from about 7.0% to about 19.0% by weight of sodium chloride;

from about 48.25% to about 68.25% by weight of sodium metasilicate;

from about 10.2% to about 20.2% by weight of sodium carbonate;

from about 0.2% to about 3.8% by weight of hydroxy ethyl cellulose;

from about 0.2% to about 3.75% by weight of ethylene glycol monobutyl ether;

from about 2.0% to about 12.0% by weight of sodium lauryl sulfate; and from about 2.0% to about 6.0% by weight of ethoxylated alcohol, based on a total weight of the non-caustic solid powder cleaner composition.

5. The composition of claim 4, wherein:

a weight percent ratio of the ethoxylated alcohol to sodium lauryl sulfate ranges from about 1:1.4 to about 1:2.2;

a weight percent ratio of the ethoxylated alcohol to sodium metasilicate ranges from about 1:13 to about 1:16;

a weight percent ratio of the ethoxylated alcohol to sodium carbonate ranges from about 1:3.0 to about 1:4.5; or a weight percent ratio of the ethoxylated alcohol to sodium chloride ranges from about 1:2.5 to about 1:3.5, based on the total weight of the non-caustic solid powder cleaner composition.

6. The composition of claim 4, wherein:

a weight percent ratio of the combined weight percent of ethyoxylated alcohol and sodium lauryl sulfate to sodium metasilicate ranges from about 1:5.0 to 1:5.5; or a weight percent ratio of the combined weight percent of ethyoxylated alcohol and sodium lauryl sulfate to the combined weight percent of sodium chloride, sodium carbonate, hydroxy ethyl cellulose and ethylene glycol monobutyl ether ranges from about 1:2.5 to about 1:3.5, based on the total weight of the non-caustic solid powder cleaner composition.

7. The composition of claim 4, wherein composition consists of:

from about 10.0% to about 14.0% by weight of sodium chloride;

from about 53.25% to about 63.25% by weight of sodium metasilicate;

from about 13.2% to about 17.2% by weight of sodium carbonate;

from about 0.25% to about 3.0% by weight of hydroxy ethyl cellulose;

from about 0.25% to about 3.0% by weight of ethylene glycol monobutyl ether;

from about 5.0% to about 9.0% by weight of sodium lauryl sulfate; and from about 2.0% to about 6.0% by weight of ethoxylated alcohol, based on a total weight of the non-caustic solid powder cleaner composition.

8. A method for manufacturing a non-caustic solid powder cleaner composition comprising:

forming a solid mixture by combining sodium chloride, at least one chelator, at least one solid carbonate base, and at least one thickening agent;

forming a surfactant mixture by combining an amount of an ethoxylated alcohol and an amount of sodium lauryl sulfate;

adding at least one stabilizer to the solid mixture for a first time duration; and forming the non-caustic solid powder cleaner composition by adding the surfactant mixture to the solid mixture for a second time duration and mixing without grinding, wherein the non-caustic solid powder cleaner composition comprises:

from about 7.0% to about 19.0% by weight of sodium chloride;

from about 48.25% to about 68.25% by weight of sodium metasilicate;

from about 10.2% to about 20.2% by weight of sodium carbonate;

from about 0.2% to about 3.8% by weight of hydroxy ethyl cellulose;

from about 0.2% to about 3.75% by weight of ethylene glycol monobutyl ether;

from about 2.0% to about 12.0% by weight of sodium lauryl sulfate; and from about 2.0% to about 6.0% by weight of ethoxylated alcohol, based on a total weight of the non-caustic solid powder cleaner composition.

9. The method of claim 8, wherein the method further comprises monitoring homogeneity of the non-caustic solid powder cleaner composition by measuring density.

10. The method of claim 8, wherein:

the first time duration is from about 3 minutes to about 8 minutes, or the second time duration is from about 3 minutes to about 8 minutes, or the first time duration and the second time duration are non-simultaneous.

11. The method of claim 8, wherein at least one chelator comprises Ethylenediaminetetraacetic acid (EDTA), ethylene glycol-bis(β-aminoethyl ether)-N,N,N',N'-tetraacetic acid (EGTA), sodium citrate, a carboxylic acid chelator, or a combination thereof.

12. The method of claim 8, wherein the at least one solid carbonate base comprises sodium bicarbonate, a carbonic acid salt, or a combination thereof, and wherein the at least one thickening agent comprises agar, further wherein the at least one stabilizer comprises ethylene glycol, polyethylene glycol, or a combination thereof.

* * * * *